US008240953B2

(12) United States Patent
Loeb

(10) Patent No.: US 8,240,953 B2
(45) **Date of Patent: *Aug. 14, 2012**

(54) GEOMETRIC UNIVERSAL PUMP PLATFORM

(75) Inventor: James Bradley Loeb, Cypress, TX (US)

(73) Assignee: Trident Subsea Technologies, LLC, Houston, TX (US)

( * ) Notice: Subject to any disclaimer, the term of this patent is extended or adjusted under 35 U.S.C. 154(b) by 492 days.

This patent is subject to a terminal disclaimer.

(21) Appl. No.: 12/119,782

(22) Filed: May 13, 2008

(65) Prior Publication Data

US 2008/0282777 A1 Nov. 20, 2008

Related U.S. Application Data

(60) Provisional application No. 60/930,611, filed on May 17, 2007.

(51) Int. Cl.
*B63B 35/00* (2006.01)

(52) U.S. Cl. ..... 405/154.1

(58) Field of Classification Search ..... 73/49.1, 73/49.5; 166/336, 337; 405/154.1
See application file for complete search history.

(56) References Cited

U.S. PATENT DOCUMENTS

| | | | |
|---|---|---|---|
| 3,466,001 | A | 9/1969 | Nelson |
| 3,520,358 | A | 7/1970 | Brooks et al. |
| 3,640,299 | A | 2/1972 | Nelson |
| 3,691,493 | A | 9/1972 | Boysen et al. |
| 3,708,990 | A | 1/1973 | Crooke |
| 3,777,499 | A | 12/1973 | Matthews, Jr. |
| 3,788,084 | A | 1/1974 | Matthew, Jr. |
| 3,961,493 | A | 6/1976 | Nolan, Jr. et al. |
| 4,155,669 | A | 5/1979 | Rochelle |
| 4,165,571 | A | 8/1979 | Chang et al. |
| 4,229,121 | A | 10/1980 | Brown |
| 4,234,268 | A | 11/1980 | Scodino |
| 4,332,277 | A | 6/1982 | Adkins et al. |
| 4,344,319 | A | 8/1982 | Hancock et al. |
| 4,445,804 | A | 5/1984 | Abdallah et al. |
| 4,463,597 | A | 8/1984 | Pierce et al. |
| 4,615,571 | A | 10/1986 | Swank |
| 4,906,136 | A | 3/1990 | Norbom et al. |
| 5,044,827 | A | 9/1991 | Gray et al. |

(Continued)

FOREIGN PATENT DOCUMENTS

| | | |
|---|---|---|
| GB | 2195739 | 4/1998 |

(Continued)

OTHER PUBLICATIONS

Graves Syd. "Vessel-Free Flooding of Deepwater Pipelines Using the Copipe SPU"; The Deepwater Pipeline Technology Conference, New Orleans, LA; Mar. 9-11, 1988 (pp. 15).

(Continued)

*Primary Examiner* — John Fitzgerald
(74) *Attorney, Agent, or Firm* — Conley Rose, P.C.

(57) ABSTRACT

The present invention is directed to a Geometric Universal Pumping Platform (GUPP) that comprises a platform containing an electric motor that drives a hydraulic pump for producing high pressure hydraulic fluid and one or more pumps powered by the hydraulic fluid from the hydraulic pump. The pump is selected for the desired commissioning method to be carried out, such as flooding, chemical treating, pigging, hydrostatic testing or dewatering the pipeline. The GUPP is suspended from a vessel by an umbilical that provides the electric current for the electric motor supported by the GUPP.

9 Claims, 5 Drawing Sheets

U.S. PATENT DOCUMENTS

| | | | | |
|---|---|---|---|---|
| 5,192,167 | A | 3/1993 | da Silva et al. | |
| 5,267,616 | A | 12/1993 | Silva et al. | |
| 5,273,376 | A | 12/1993 | Ritter, Jr. | |
| 5,348,451 | A | 9/1994 | Mohn | |
| 5,421,674 | A | 6/1995 | Maloberti et al. | |
| 5,842,816 | A | 12/1998 | Cunningham | |
| 5,883,303 | A | 3/1999 | Bliss et al. | |
| 5,927,901 | A | 7/1999 | Graves | |
| 5,975,803 | A | 11/1999 | Mackinnon | |
| 6,022,421 | A | 2/2000 | Bath et al. | |
| 6,109,829 | A | 8/2000 | Cruickshank | |
| 6,145,223 | A | 11/2000 | Flesen | |
| 6,170,493 | B1 | 1/2001 | Sivacoe | |
| 6,171,025 | B1 * | 1/2001 | Langner et al. | 405/154.1 |
| 6,200,068 | B1 | 3/2001 | Bath et al. | |
| 6,234,717 | B1 | 5/2001 | Corbetta | |
| 6,290,431 | B1 | 9/2001 | Exley et al. | |
| 6,336,238 | B1 | 1/2002 | Tarlton | |
| 6,435,279 | B1 | 8/2002 | Howe et al. | |
| 6,454,492 | B1 | 9/2002 | Dean et al. | |
| 6,503,021 | B2 | 1/2003 | Corbetta | |
| 6,539,778 | B2 | 4/2003 | Tucker et al. | |
| 6,549,857 | B2 | 4/2003 | Fierro et al. | |
| 6,596,089 | B2 | 7/2003 | Smith et al. | |
| 6,763,889 | B2 | 7/2004 | Rytlewski et al. | |
| 6,840,088 | B2 | 1/2005 | Tucker et al. | |
| 7,011,152 | B2 | 3/2006 | Soelvik | |
| 7,093,661 | B2 | 8/2006 | Olsen | |
| 7,281,880 | B2 | 10/2007 | Tucker et al. | |
| 7,708,839 | B2 * | 5/2010 | Yemington | 134/22.11 |
| 7,765,725 | B2 * | 8/2010 | Jacobsen et al. | 37/317 |
| 2002/0040782 | A1 | 4/2002 | Rytlewski et al. | |
| 2002/0040872 | A1 | 4/2002 | Bogoev et al. | |
| 2002/0059687 | A1 | 5/2002 | Smith et al. | |
| 2002/0059887 | A1 | 5/2002 | Marshall et al. | |
| 2002/0129641 | A1 * | 9/2002 | Tucker et al. | 73/49.5 |
| 2003/0010094 | A1 * | 1/2003 | Tucker et al. | 73/49.5 |
| 2003/0145991 | A1 | 8/2003 | Olsen | |
| 2003/0154769 | A1 | 8/2003 | Tucker et al. | |
| 2003/0170077 | A1 | 9/2003 | Herd et al. | |
| 2007/0003371 | A1 | 1/2007 | Yemington | |
| 2008/0282776 | A1 * | 11/2008 | Loeb et al. | 73/49.5 |
| 2009/0288836 | A1 * | 11/2009 | Goodall et al. | 166/336 |
| 2010/0085064 | A1 * | 4/2010 | Loeb et al. | 324/537 |
| 2010/0089126 | A1 * | 4/2010 | Sweeney | 73/40 |

FOREIGN PATENT DOCUMENTS

| | | |
|---|---|---|
| GB | 2421530 | 6/2006 |
| JP | 226185 | 8/1994 |
| WO | 02084160 | 10/2002 |
| WO | 02088658 | 11/2002 |

OTHER PUBLICATIONS

Graves, Les; "Deepwater Pipeline Flooding and Pigging Without Connection to a Surface Vessel"; Transactions-Institute of marine Engineers, Seriec C, 1999, vol. 111, Nr. 1, (pp. 151-160).

Graves, Les, "Controlled Deepwater Pipeline Flooding & Pigging Without Connection to a Surface Vessel"; Pipeline & Gas Journal; Aug. 2001; (pp. 2).

Engelmann, Georg; Dupre, Mike. "Development and Utilization of an all Subsea, ROV Based, Flowline Pre-Commissioning System" Offshore Technology Conference OTC 15146; May 2003; (pp. 5).

Furlow, William; "Smaller, Shallow Tieback Market Grown"; Offshore Magazine, Subsea/Surface Systems, Dec. 2003; [online] Retrieved from the Internet on Jun. 22, 2009; <URL: http://www.offshore-mag.c; (pp. 5).

Ghiselin, Dick; "Wunderbar!"; E&P Magazine; Feb. 1, 2004 [online] Retrieved from the Internet on Jun. 22, 2009; <URL: http://www.epmag.com/ar; (pp. 2).

Frontier 300 Subsea Flooding Unit; Weatherford, Subsea Tieback Conference Forum, Galveston, Texas; Mar. 2005; (pp. 2).

Proposal relating to Pipeline Service Solutions to Independence Hub Integrated Project Team; Jun. 2005; (see p. 5); (pp. 14).

Pipeline & Specialty Services; Weatherford; Presented at SGA Offshore, LA; Aug. 2005; (pp. 44).

International Search Report and Written Opinion Dated Aug. 28, 2008 for Appl. No. PCT/US2008/063599 (10 p.).

Rigzone—Planning and Problem Solving in the Offshore Environment, May 21, 2003 (http://www.rigzone.com/news/article.asp?a_id=6731) (8 pp).

U.S. Office Action dated Mar. 31, 2011, U.S. Appl. No. 12/119,763.

* cited by examiner

GEOMETRIC UNIVERSAL PUMP PLATFORM

CROSS-REFERENCE TO RELATED APPLICATIONS

The present application claims the benefit of 35 U.S.C. 111(b) provisional application No. 60/930,611, filed May 17, 2007, entitled "Universal Pumping Platform". A related application of James B. Loeb and Kurt S. Myers, filed concurrently, entitled "Universal Pump Platform", which is incorporated herein by reference.

STATEMENT REGARDING FEDERALLY SPONSORED RESEARCH OR DEVELOPMENT

Not applicable.

FIELD OF THE INVENTION

The present invention is directed to a geometric universal pump platform (GUPP) commissioning system for deep water pipelines. More specifically, the GUPP comprises a geometric platform containing an electric motor that drives a hydraulic pump for producing high pressure hydraulic fluid and one or more pumps powered by the hydraulic fluid from the hydraulic pump. The pump(s) is selected for filling, chemical treating, pigging, hydrostatic testing or dewatering the pipeline. The GUPP is suspended from a vessel by an umbilical that provides the electric current for the electric motor.

BACKGROUND OF THE INVENTION

U.S. Pat. No. 6,539,778; U.S. Pat. No. 6,840,088; and U.S. Pat. No. 7,281,880 are directed to pumping skids that are connected to a subsea vehicle (SV) to carry out pipeline commissioning methods. By their design, the pumping skids are attached to the underside of the SV and require the SV to power the pumps on the skid. When commissioning a pipeline, the skid and SV act as a single unit.

The present invention employs an independent Geometric Universal Pumping Platform that has its own power supply provided by an umbilical from a vessel to an electric motor that drives a hydraulic pump for producing high pressure hydraulic fluid. This hydraulic fluid is then used to power one or more pumps depending on the specific commissioning operation. The GUPP is independent, structurally or for a source of power, of any SV or ROV used in the commissioning operations.

SUMMARY OF THE INVENTION

The present invention is directed to a Geometric Universal Pumping Platform (GUPP) that comprises a platform containing an electric motor that drives a hydraulic pump for producing high pressure hydraulic fluid and one or more pumps powered by the hydraulic fluid from the hydraulic pump. The pump is selected for the desired commissioning method to be carried out, such as flooding, hydrostatic testing or dewatering the pipeline. The GUPP is suspended from a vessel by an umbilical that provides the electric current for the electric motor supported by the GUPP.

BRIEF DESCRIPTION OF THE PREFERRED EMBODIMENTS OF THE PRESENT INVENTION

Subsea pipelines are utilized to transport the discovered product from wells drilled subsea to a variety of disposition points. These points include existing or new offshore platforms, new pipelines or old pipelines, all of which are transporting the hydrocarbon products to onshore facilities. The pipelines terminate subsea in manifolds, used herein as a generic term, to include for example, wellhead trees, pipeline end manifolds (PLEMs), and pipeline end terminators (PLETs), to name a few. As new wells are completed, subsea pipelines form a matrix of flow for the oil/gas products that are tied through these manifolds to bring the product to shore. As dictated by law, the new sections of pipeline require hydrostatic testing to make certain that the line has no leaks. In addition to hydrostatic testing, other steps in the commissioning of the pipeline may be required, including flooding, pigging, cleaning, and installing chemicals that prepare the pipeline for hydrostatic testing or dewatering and drying that may follow the successful hydrostatic testing.

Once a well is completed, a pipeline is connected to the production well pipelines for transporting the product to shore. The pipeline commissioned by the present invention often does not extend all the way to shore but is at the outer part of the matrix, a section or segment measured in hundreds or thousand of feet. Also common to a manifold as used herein is that there is structure to provide internal access to the pipeline, with a structure known as a hot stab. The subsea performance or operation of the commissioning methods of the present invention will be described as commissioning a pipeline between two manifolds or PLEMs.

The present invention relates to the commissioning of these subsea pipelines carried out on the pipelines on the seabed by using a Geometric Universal Pumping Platform (GUPP) that is suspended by an umbilical from a vessel. An umbilical is a composite cable. The function of the cable is multipurpose in that it provides (1) electric current from the vessel to the platform, for the hydraulic pump(s) and possibly lights, instrumentation, or other functions; (2) data transmission; (3) strength for supporting the platform at the tethered position or depth.

Figure 1:
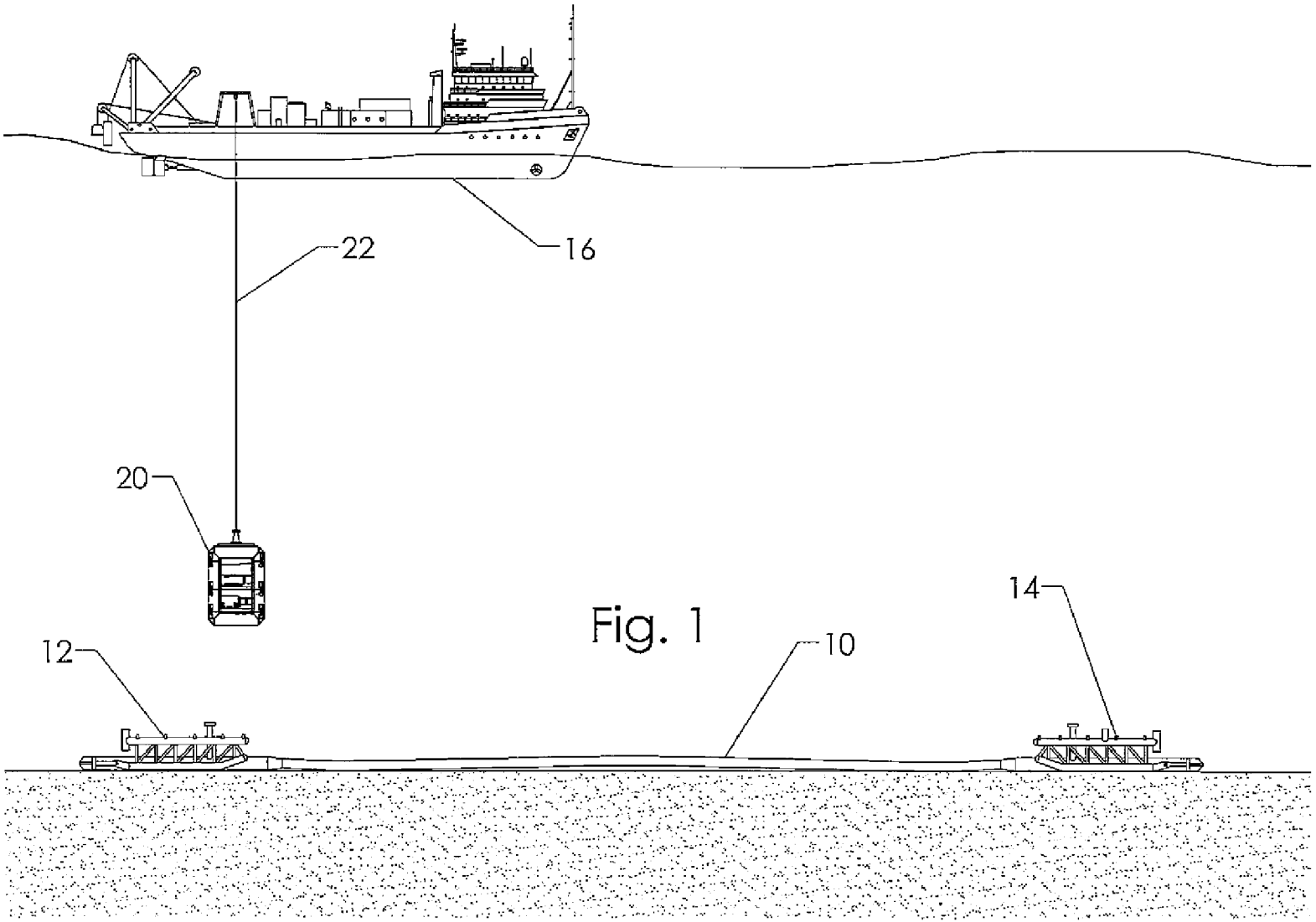
FIG. 1 is a schematic view of a pipeline that is to be commissioned that has at least one hot stab to access the pipeline and a Geometric Universal Pump Platform (GUPP) of the present invention suspended from a vessel to carry out a commissioning method on the deep water pipeline.

Referring to FIG. 1, a deep water pipeline 10 lies on or near the sea floor between a PLEM 12 and a second PLEM 14. The pipeline 10 may be a new line or an old line that requires a commissioning method of the present invention. If newly laid, the pipe may have the PLEM 12 connected to the pipe as it comes off the pipe laying vessel and this structure is lowered to the subsea floor. The PLEM 14 on the other end of the pipe may be lowered to the subsea floor to complete the pipeline. A new pipeline usually has air in the line and requires a flooding commissioning method prior to hydrostatic testing while an old line has water already in the line. A vessel 16 is positioned above pipeline 10 and a GUPP 20 is launched over the side of the vessel 16 and lowered in the near vicinity of PLEM 12 to carry out one of the commissioning methods of the present invention.

A Geometric Universal Pumping Platform (GUPP) 20 comprises a non-buoyant structure, that may be round or is square (meaning four sided) or substantially more than a square up to and including dodecagonal (12 sides), consisting of a metal, preferably aluminum, frame that supports an electric motor that drives a hydraulic pump for producing high pressure hydraulic fluid and one or more pumps powered by the hydraulic fluid for the desired commissioning method. The GUPP is suspended from a vessel by an umbilical 22 that provides the electric current for an electric motor supported by the GUPP.

The geometric platform (GUPP) is highly flexible in that one or more electric lines may be in the umbilical composite cable. Thus, one or more electric motors may power hydraulic pumps or water pumps. A hydraulic pump on the platform will provide high pressure hydraulic fluid to power a single pump or a plurality of pumps for pumping water suitable to meet the design requirements of the specific commissioning method at the depth pressures and pipe sizes of a specific subsea pipeline. The requirements for hydrostatic testing, for example, is a single pump, or a plurality of pumps, for pumping seawater at high pressure into a pipeline to increase the internal pressure to hydrostatic testing requirements (see API RP 1110; API RP 1111; ASME B31.4-2002; ASME B31.8-2003; approximately 1.25×m.o.p. of the pipeline).

In addition, the platform may have a data transmitting or collecting interface. Examples are data lines connected to pipeline water pressure and/or temperature devices; and electronic devices for measuring whether stabs of lines for water flow or data are connected securely, and feedback on the status of platform equipment. Flow rates or volume of water pumped may also be measured and the data transmitted through the umbilical to the vessel. Pigs passed through the pipeline during a pigging commissioning method may be detected or measured, either the launching of a pig into the pipeline from a pig launcher or the recovery of a pig from the pipeline into a pig receiver. Smart pigs or other electronics may provide information of a pig as it flows through the pipeline, and acoustic data may be transmitted by the pig, received by the platform, and relayed to the surface via the umbilical to the platform.

Advantages of the GUPP are:

1) No concern for the weight of the platform (GUPP) as opposed to a skid attached to an ROV.
2) No buoyancy foam. Cost savings of $40,000 to $50,000.
3) Unlimited depth range as opposed to the limitations of buoyancy of an ROV.
4) Smaller in physical size with no foam. Deck space is always at a premium on the vessels.
5) Does not have to be uncoupled from the ROV to be worked on. All aspects of platform are immediately accessible.
6) Because it is not connected to the ROV and using its hydraulic HP (hydraulic pump), the platform can be easily used on ships with older ROV equipment of lesser horsepower.
7) Standing alone the platform can be configured into many sizes and shapes and weights whereas all ROVs have limits to how much weight can be attached to them.

Specific embodiments of the present invention are set forth in the drawings and description hereinafter.

Figure 2:
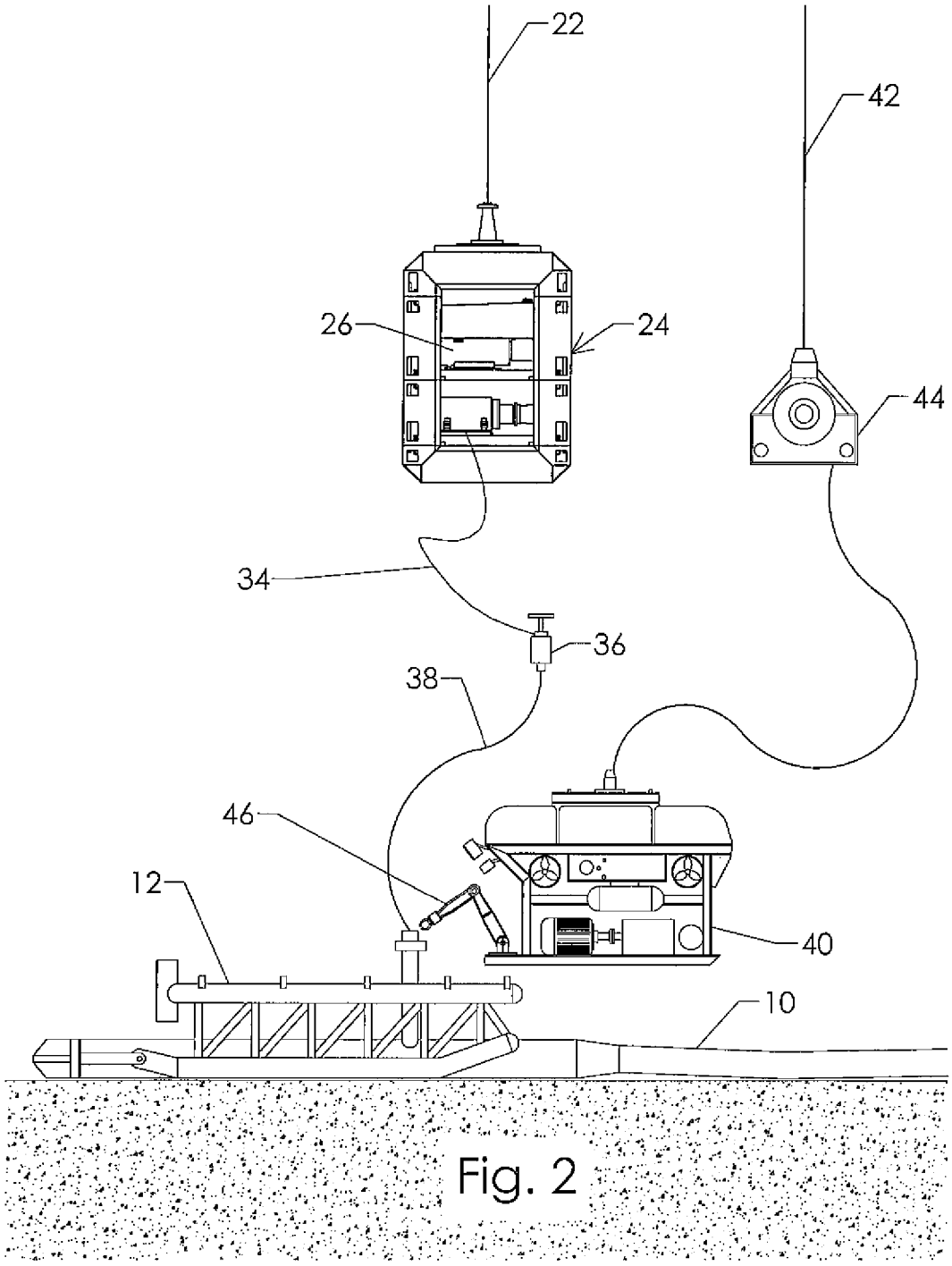
FIG. 2 is a schematic view of a GUPP having a high pressure pump on the GUPP with a line having a stab to be connected to a hot stab on the pipeline by a Remote Operated Vehicle (ROV) to carry out a hydrostatic test commissioning method on the deep water pipeline.

Referring now to FIG. 2, a GUPP 20 is lowered by an umbilical 22 above and in the vicinity of PLEM 12. This GUPP 20 is designed specifically for hydrostatic testing and characterized by an aluminum frame 24. The frame supports a power assembly 26 that is connected to the umbilical 22. The power assembly includes an electric motor that powers a hydraulic pump that powers a hydraulic motor. The hydraulic motor, in this embodiment, provides the power to the pumps carried by frame 24; namely, a high pressure triplex reciprocating pump, that is in a pump box, for pumping seawater into the pipeline 10 for hydrostatic testing. Preferably, the frame structure 24 carries one or more chemical pump(s) that are also in the box. A line 34 transfers the high pressure water and chemicals through a break-away device 36 and a line 38 having a stab for connecting to a hot stab opening in PLEM 12. A remote operating vehicle (ROV) 40 is used to stab line 38 into PLEM 12.

The ROV has its own umbilical 42 which is shown connected to a tether management system (TMS) 44. The ROV's gripper 46 is manipulated to open and shut valves on the GUPP's pumps to perform the operational procedures for the commissioning method.

Figure 3:
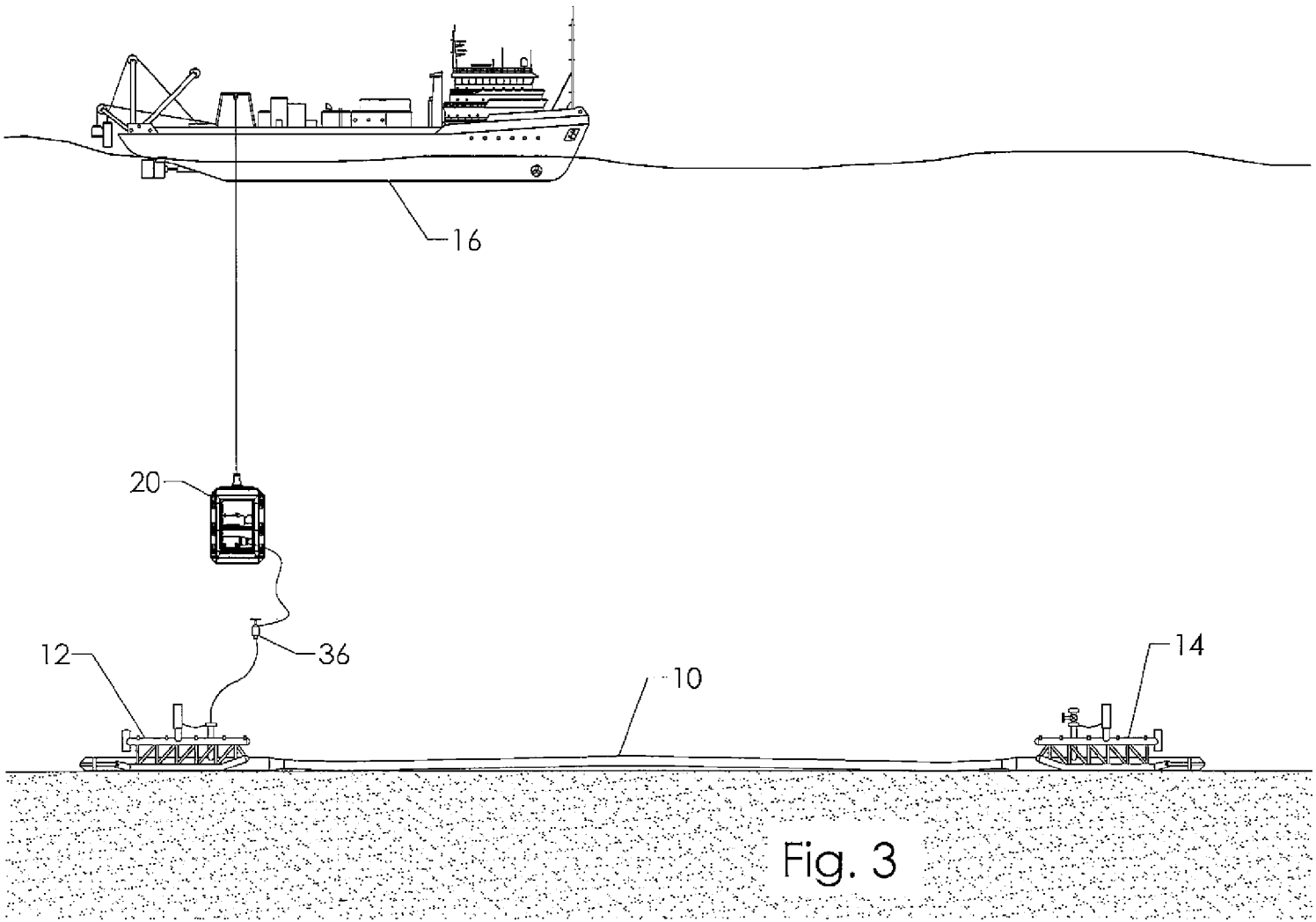
FIG. 3 is a schematic view of the GUPP operating completely from a vessel.

Referring now to FIG. 3, the platform herein does not require the interface of a robotic operating vessel (ROV) to power the pumps on the platform. The water pump(s) on the platform herein are directly powered by the hydraulic pump on the GUPP. The GUPP of the present invention and the ROV are independent. The pumps on the GUPP may operate once connected to the pipeline without the ROV; the ROV is free to do other operations when the pumps on the platform are running; and in times of bad weather, the disconnect operations are independent of the ROV.

Figure 4:
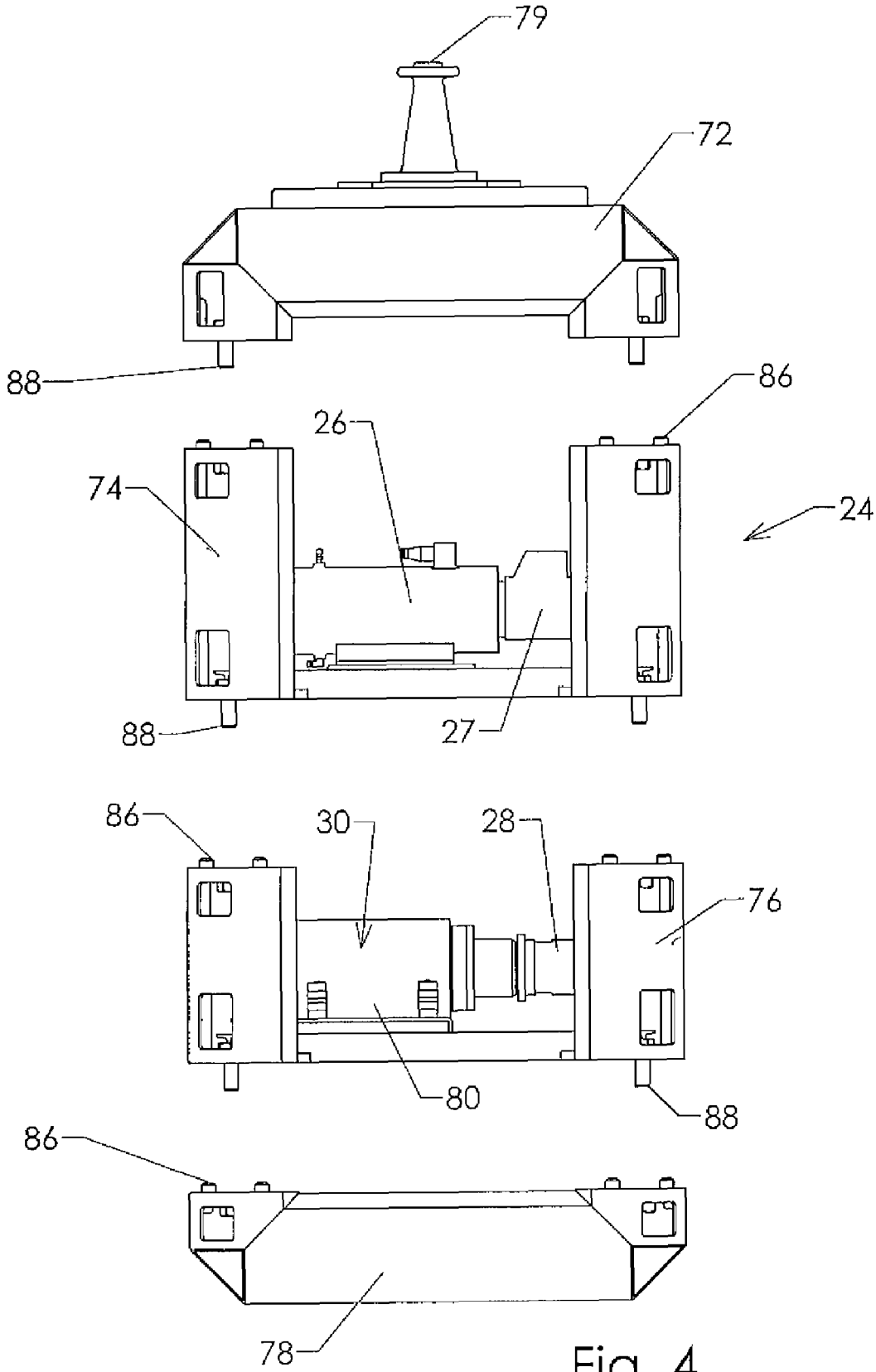
FIG. 4 is a schematic-expanded view of a GUPP with a hydrostatic testing pump.
Figure 5:
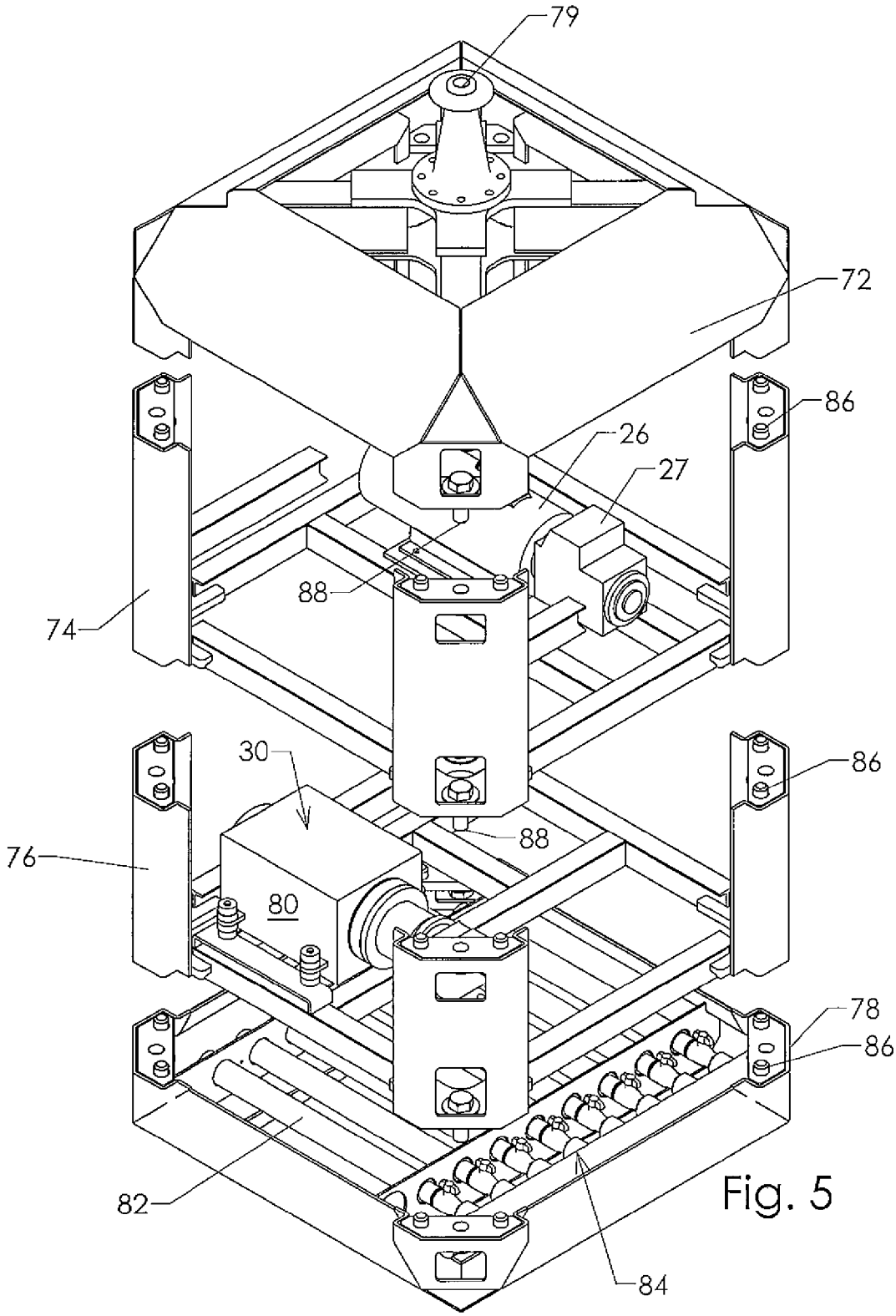
FIG. 5 is a schematic-isometric expanded view of the GUPP of FIG. 4.

The GUPP of the present invention is a specific geometric design of the UPP referred to in the application above. Referring now to FIG. 4 and FIG. 5, the GUPP of the present invention has an octagonal frame and is constructed in multiple layers. The preferred embodiment of the GUUP has an eight sided (octagonal) frame 24 and four layers, 72, 74, 76, and 78. The top or upper layer 72 has an opening 79 where the umbilical 22 enters and connects to an electric junction box (not shown) which is securely attached to layer 72. On the next layer 74 is an electric motor 26 that powers a hydraulic pump 27. In this embodiment, hydraulic pump 27 powers a hydraulic motor 28 that powers pump 30 that is mounted in pump box 80 on the next level 76. Pump 30 is preferably a high pressure triplex reciprocating pump. Also in pump box 80 are one or more chemical pumps for adding chemicals to the water. While only one hydraulic motor 28 is shown, it is understood that each pump in pump box 80 may have separate and individual hydraulic motors. In the layer 78 is a filter arrangement. Specifically, replaceable filters 82 are connected by a plenum or manifold 84 that supplies filtered water to pump 30. The manifold 84 is connected to the inlet of pump 30 in pump box 80. The outlet of the pump box 80 that collects the water from pump 30 and the chemicals from chemical pump(s) connects to line 34, 38.

Still referring to FIGS. 4 and 5, the short sides of frame 24 have positioning pins 86 on the top of layers 74, 76, and 78 and a hole in the middle for a bolt 88. In FIG. 4, bolts 88 are shown that secure layer 76 to layer 78; layer 74 to layer 76; and layer 72 to layer 74. In addition, spot welds may be used to secure the layers to form a frame of greater strength.

What is claimed is:

1. A commissioning system for deep water pipelines comprising:

a non-buoyant geometric platform suspended from a first umbilical configured to support the entire weight of the platform, wherein the platform comprises:

a frame;

an electric motor mounted on the frame and configured to drive a hydraulic pump for pressurizing hydraulic fluid; and a pump disposed on the platform, wherein the pump is configured to be powered by a hydraulic motor powered by said hydraulic fluid;

a remotely operated vehicle independent of the platform and attached to a second umbilical, wherein the remotely operated vehicle is configured to operate a valve of the pump:

wherein said pump is configured to perform a commissioning method selected from filling, chemical treating, pigging, hydrostatic testing and dewatering on a subsea pipeline:

wherein the platform comprises a plurality of layers coupled together one above the other.

2. A commissioning system according to claim 1 wherein said metal is aluminum.

3. A commissioning system according to claim 1 wherein said pump is a high pressure triplex reciprocating pump.

4. A commissioning system according to claim 1 wherein each level is octagonal.

5. A commissioning system according to claim 4 wherein each level is stacked and adjacent levels are bolted together.

6. A commissioning system according to claim 1 further comprising:

a manifold disposed on the sea floor and coupled to the subsea pipeline;

a conduit connecting the pump to the manifold.

7. A commissioning system according to claim 6 wherein the remotely operated vehicle is configured to stab an end of the conduit into the manifold.

8. A commissioning system according to claim 1 wherein the first umbilical is configured to transmit data between the platform and a vessel.

9. A commissioning system according to claim 6 wherein the conduit comprises a break-away device configured to disconnect the conduit from the manifold.

* * * * *